US009469910B2

(12) United States Patent
Wolfowitz

(10) Patent No.: US 9,469,910 B2
(45) Date of Patent: Oct. 18, 2016

(54) PRODUCTION OF HYDROCARBONS

(75) Inventor: Steven Alan Wolfowitz, Rossburgh (ZA)

(73) Assignee: FFGF LIMITED, Tortola (VG)

( * ) Notice: Subject to any disclaimer, the term of this patent is extended or adjusted under 35 U.S.C. 154(b) by 789 days.

(21) Appl. No.: 13/505,929

(22) PCT Filed: Nov. 4, 2010

(86) PCT No.: PCT/IB2010/055001

§ 371 (c)(1),
(2), (4) Date: Jun. 5, 2012

(87) PCT Pub. No.: WO2011/055322

PCT Pub. Date: May 12, 2011

(65) Prior Publication Data

US 2012/0228148 A1 Sep. 13, 2012

(30) Foreign Application Priority Data

Nov. 4, 2009 (ZA) ..... 2009/07752
Sep. 3, 2010 (ZA) ..... 2010/06338

(51) Int. Cl.

| | |
|---|---|
| ***C25B 9/08*** | (2006.01) |
| ***C25B 3/04*** | (2006.01) |
| ***C25B 15/08*** | (2006.01) |
| ***C25B 9/00*** | (2006.01) |

(52) U.S. Cl.

CPC . *C25B 9/08* (2013.01); *C25B 3/04* (2013.01); *C25B 9/00* (2013.01); *C25B 15/08* (2013.01)

(58) Field of Classification Search

USPC ..... 205/413, 555, 639, 637
See application file for complete search history.

(56) References Cited

U.S. PATENT DOCUMENTS 736,868 A * 8/1903 McCarty ..... C25B 1/04 204/278
813,105 A * 2/1906 McCarty ..... C25B 1/04 204/274
1,581,944 A * 4/1926 Hausmeister ..... C25B 15/00 205/338

(Continued)

FOREIGN PATENT DOCUMENTS

| | | |
|---|---|---|
| DE | 41 26 349 A1 | 2/1993 |
| FR | 2 856 080 | 12/2004 |
| WO | WO 2008/017838 A1 | 2/2008 |

OTHER PUBLICATIONS

McCullough, T. "A semimicro salt bridge", J. Chem. Educ., 1973, 50 (11), p. 781.*

(Continued)

*Primary Examiner* — Harry D Wilkins, III
(74) *Attorney, Agent, or Firm* — Nixon Peabody LLP; Jeffrey L. Costellia

(57) ABSTRACT

This invention relates to a method for the production of hydrocarbons from carbon dioxide and water, using electrolysis and two separate reaction vessels. A first reaction vessel (14) contains a positive electrode and a liquid electrolytic medium comprising water and ionized material. A second reaction vessel (12) contains a negative electrode and a liquid electrolytic medium comprising a mixture of water and carbon dioxide. The reaction vessels are connected with connection means which allow ions to pass between the electrolytic media of the first and second reaction vessels. A direct electrical current is applied to the positive electrode and the negative electrode to produce hydrocarbons (typically methane); and oxygen.

7 Claims, 3 Drawing Sheets

(56) References Cited

U.S. PATENT DOCUMENTS

| | | | | |
|---|---|---|---|---|
| 3,374,158 | A * | 3/1968 | Lord | C25B 1/12 204/270 |
| 3,401,099 | A * | 9/1968 | McEvoy | B01D 53/326 205/338 |
| 4,042,481 | A * | 8/1977 | Kelly | C25B 9/06 204/270 |
| 4,086,393 | A * | 4/1978 | Hart | 429/51 |
| 4,242,193 | A * | 12/1980 | Moeglich | B01D 61/50 204/252 |
| 4,545,872 | A * | 10/1985 | Sammells | B01D 61/00 204/157.15 |
| 4,897,167 | A | 1/1990 | Cook et al. | |
| 6,942,766 | B2 * | 9/2005 | Lemke | C02F 1/46104 204/242 |
| 2007/0170051 | A1 * | 7/2007 | Schlaikjer | G21B 3/00 204/268 |
| 2008/0223727 | A1 | 9/2008 | Oloman et al. | |
| 2011/0114501 | A1 * | 5/2011 | Teamey et al. | 205/351 |
| 2013/0287636 | A1 * | 10/2013 | Shitara | C25B 1/00 422/162 |

OTHER PUBLICATIONS

Monk, Paul. "Physical Chemistry: Understanding our Chemical World" p. 342, 2004.*

"Vessel." Merriam-Webster.com. Merriam-Webster, n.d. Web. Jul. 23, 2015. <http://www.merriam-webster.com/dictionary/vessel>.*

Hara et al., "Electrocatalytic Formation of $CH_4$ from $CO_2$ on a Pt Gas Diffusion Electrode", Journal of the Electrochemical Society, Electrochemical Society, vol. 144, No. 2, Feb. 1997, pp. 539-545.

International Search Report for PCT/IB2010/055001 dated Mar. 3, 2011.

* cited by examiner

PRODUCTION OF HYDROCARBONS

BACKGROUND OF THE INVENTION

The planet Earth is currently plagued by two major problems having severe effects on it and its inhabitants, namely:

- global warming resulting from excessive carbon dioxide production; and
- excessively high crude oil and consequently high petrol and diesel prices.

An object of this invention is to reduce these problems and thus improve the future of the world.

The increase in production of fossil fuel utilizing engines has resulted in excessive demand for crude oil in turn resulting in excessively high prices. The consumption of these fuels has increased the amount of carbon dioxide produced which has led to global warming. The absorbtion of carbon dioxide by trees and resulting release of oxygen has been debilitated by the removal of extensive forests. This imbalance has thrown and continues to cumulatively throw the world's ecology out of kilter.

Efforts to improve efficiencies of engines and reduce wastage of fossil fuel products have little chance of improving the situation because of exponentially growing populations and their aspirations. Other technologies are actively being sought.

Ways to address the problems mentioned above include:

- reduction of carbon dioxide in the atmosphere;
- reduction of 'carbon footprint' (the use of carbon products); and
- reduction of demand for crude oil and other fossil fuels (resulting in a decrease in their prices, by finding replacements).

It is an object of this invention to provide a process and apparatus which contributes to the above reductions and further provides a chemical raw material feedstock for the production of hydrocarbons, including fuels.

SUMMARY OF THE INVENTION

A method for the production of hydrocarbons from carbon dioxide and water includes the steps of:

(a) providing a first reaction vessel (14) containing a positive electrode and a liquid electrolytic medium comprising water and ionizing material;

(b) providing a second reaction vessel (12) containing a negative electrode and a liquid electrolytic medium comprising a mixture of water and carbon dioxide;

(c) connecting the first and second reaction vessels with connection means which allows electrons and/or ions to pass between the electrolytic media of the first and second reaction vessels;

(d) applying a direct electrical current to the positive electrode and the negative electrode to:

- cause electrons to flow from the cathode to the anode (or transmit their charges from atom to adjacent atom thereby ionizing them and de-ionising them successively) through the electrolytic media in the reaction vessels (12) and (14);
- effect ionization of hydrogen, carbon in the second reaction vessel and to produce positively charged hydrogen and carbon ions which combine to form hydrocarbons (typically methane), and possibly carbon, hydrogen and carbon monoxide;
- effect ionization of oxygen in the first reaction vessel, which combine to form oxygen.

Hydrocarbons (typically methane) are recovered from the second reaction vessel (12).

Oxygen is recovered from the first reaction vessel (14).

The reaction vessels (12) and (14) are operated at the same internal pressure, and may be operated at different temperatures.

The connection means may be a liquid electrolytic medium, in which case a membrane which allows electrons to pass through, and possibly some ions, but not atoms, may be provided.

The connection means may be defined by one or more tube/s, such as capillary tube/s.

Preferably, the connection means is provided with stopper means such as a valve or valves.

The ratio of internal diameter to length of the/each tube may be from 0.00001:1 to 0.1:1, preferably from 0.00001:1 to 0.001:1

The positive electrode in the first reaction vessel (14) may be in the form of a hollow microporous cylinder which is closed at one end and which is made of Pt.

The negative electrode in the second reaction vessel (12) may be in the form of a hollow microporous cylinder which is closed at one end and which is made from a CuPt amalgam or Pt.

The liquid state of the electrolytic media in the first and second reaction vessels (14) and (12) may be achieved by operating the vessels under a suitable high pressure and at a suitable temperature.

For example, the first and second reaction vessels (14) and (12) should be operated at a pressure of above 5.1 atm, from 5.1 to 1000 atm, typically from 10 atm to 400 atm, preferably from 10 to 200 atm.

The reaction vessels (12) and (14) may be operated at different temperatures, for example the first reaction vessel (14) may be operated at a temperature of 20° C. to 200° C., typically from 20° C. to 30° C.; and the second reaction vessel (12) may be operated at a temperature of −50° C. to 200° C., typically −10° C. to 70° C.

Usually, the first reaction vessel (14) is operated at ambient temperature (20° C. to 30° C.), and the temperature of the second reaction vessel is controlled to a desired temperature, for example it may be cooled to from −50° C. to 10° C., or it may be heated to from 50° C. to 200° C.

The voltage applied across the positive electrode and the negative electrode may be from −0.5 v to −20 v, −0.5 v to −10 v, −0.5 v to −6 v, or −0.5 v to −3 v.

The direct current applied across the positive electrode and the negative electrode may be from 50 to 500 mA, typically from 100 to 200 mA.

The direct current applied across the positive electrode and the negative electrode if a grid of multiple electrodes is wired in parallel may be 0.1 to 10 amp or higher.

The carbon dioxide and water in the second reaction vessel may be mixed at a volumetric ratio of 1:1 to 1:2 or in stoichiometric (or greater) proportions according to the formula:

$$CO_2+2H_20 \rightarrow CH_4+2O_2.$$

Carbon dioxide, water and carbon monoxide separated from the electrolytic medium of the second reaction vessel may be recycled to the second reaction vessel.

Water separated from the electrolytic medium of the first reaction vessel may be recycled to the second reaction vessel.

The method may be carried out under conditions wherein the mixture of water and carbon dioxide in the reaction chamber (12) are supercritical fluids.

This invention also relates to an apparatus for the production of hydrocarbons from carbon dioxide and water, the apparatus comprising:

a first reaction vessel (14) for containing water in the liquid phase;

a second reaction vessel (12) for containing a mixture of carbon dioxide and water in the liquid phase;

a positive electrode located within the first reaction vessel (14);

a negative electrode located within the second reaction vessel (12); and connection means connecting electrolytic media in the first and second reaction vessels (14) and (12).

The connection means may be a liquid electrolytic medium, in which case a membrane which allows electrons to pass through, and possibly some ions, but not atoms, may be provided.

The connection means may be one or more tube/s, such as capillary tube/s.

Preferably, the connection means is provided with stopper means such as a valve or valves.

Preferably, the apparatus includes a high pressure intensifier for equalizing the pressures in both reaction vessels.

The high pressure intensifier is preferably pressurized with $CO_2$, and pressurizes the second reaction vessel (12) directly with $CO_2$, and the high pressure accumulator is provided for pressurizing the first reaction vessel (14) with $H_2O$.

DETAILED DESCRIPTION OF THE INVENTION

International Patent Application No. PCT/IB2009/053136 (the content of which is incorporated herein by reference) describes a process for the production of hydrogen, oxygen and hydrocarbons from carbon dioxide and water includes the steps of:

(a) mixing carbon dioxide in the liquid phase with water in the liquid phase to provide a liquid electrolytic medium in a vessel capable of withstanding high pressures and temperatures containing a positive electrode and a negative electrode;

(b) applying a direct electrical current to the positive electrode and negative electrode to effect ionization of hydrogen, carbon and oxygen and to produce positively charged hydrogen and carbon ions and negatively charged oxygen ions;

(c) separation of the hydrogen and carbon ions from the oxygen ions which may, conveniently, be achieved by the migration of oxygen ions to the positive electrode and migration of hydrogen and carbon ions to the negative electrode;

(d) the formation of hydrogen, possibly carbon and hydrocarbons (typically methane) from the carbon and hydrogen ions, and the formation of oxygen from the oxygen ions; and (e) collecting hydrogen, hydrocarbon and oxygen products in separate vessels (carbon may also be collected).

The forward reaction:

$$C+O_2 \rightarrow CO_2$$

occurs preferentially to the reverse on account of thermodynamic considerations.

Similarly the reaction:

$$2H_2O+CO_2 \rightarrow CH_4+2O_2$$

has overall thermodynamic requirements which are more onerous than the reverse reaction.

One of the difficulties in obtaining methane (and other hydrocarbons) during the latter process is the separation of the products once formed so that they cannot re-combine to reverse the reaction.

It is an object of this invention to provide an improved means of achieving the second (latter) reaction products by separating the product components during the process in a way that they cannot recombine because they are produced in different reaction vessels.

Figure 1:
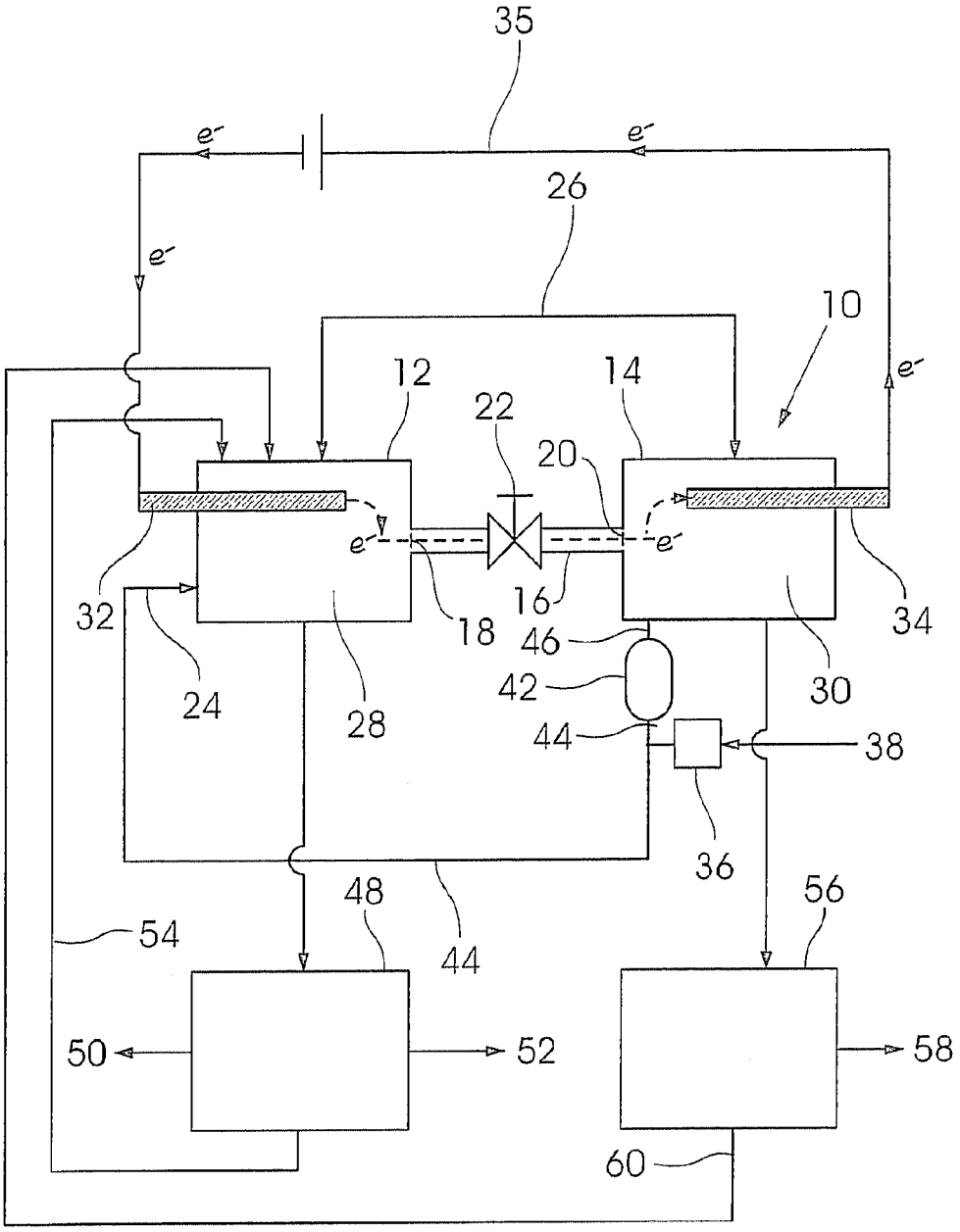
FIG. 1 is a plan of a reactor according to an embodiment of the present invention.

With reference to FIG. 1, a reactor system (indicated generally by the numeral 10) is provided with two separate reaction vessels 12 and 14 which are joined by a narrow capillary tube 16 (internal diameter of 1.2 to 1.5 mm and a length of about 2 m, thus the ratio of internal diameter to length of the tube may be from 0.00001:1 to 0.1:1), which may contain selective membranes at junction points 18 and/or 20 that allow electrons to pass, but are impervious to $CO_2$ and oxygen transfer. The capillary tube 16 has narrow dimensions which restrict temperature conduction through the materials within it so that different temperature conditions may be maintained within the separate reaction vessels 12 and 14. The capillary tube 16 is provided with a valve 22. Electron flow, or transfer, electric current, may occur within the capillary tube 16 with the physical transfer of ions. There may be multiple of capillary tubes arranged in parallel.

The reaction vessel 12 is supplied with liquid $CO_2$ 24, liquid $H_2O$ 26 and possibly a small amount of sulphur dioxide or sodium chloride to reduce the freezing temperature of water and as additional ionizing material to provide a liquid electrolytic medium 28 containing a mixture of $CO_2$ and $H_2O$.

The reaction vessel 14 is supplied with liquid $H_2O$ 26, a small quantity of ionizing material such as an acid and a small amount of sulphur dioxide, sodium chloride, or electrolyte such as $NaKHCO_3$ or $KHCO_3$ (0.1-0.5 M), may be added as catalyst to provide a liquid electrolytic medium 30 containing $H_2O$.

The capillary tube 16 may contain either liquid electrolytic medium 28 or 30, or a mixture of both, or a conductive gel.

The reaction vessel 12 is adapted to operate at a high pressure of greater than 5.1 atm, typically 5.1 to 1000 atm and at a low temperature of −50° C., to a high temperature of up to 200° C. A low temperature is attained by placing the reaction vessel 12 in a refrigerator, while a high temperature is attained using heating elements located within the reaction vessel 12. Located within the reaction vessel 12 is a negative electrode 32. The negative electrode 32 is in the form of a hollow microporous cylinder which is closed at one end and may be made from a 66%/34% CuPt amalgam or Pt.

The reaction vessel 14 is adapted to operate at a high pressure of greater than 5.1 atm to 1000 atm and at ambient temperature (20° C. to 30° C., typically 25° C.). Located within the reaction vessel 14 is a positive electrode 34 made from Pt. The positive electrode 34 is in the form of a hollow microporous cylinder which is closed at one end.

Means is provided to control the pressure within the reaction vessel 14 and/or to equalize its internal pressure with the pressure within reaction vessel 12:

a pressure intensifier 36 is supplied with $CO_2$ 38 and connected directly to reaction vessel 12 and pressurizes the reaction vessel 12 with $CO_2$ 24. The high pressure intensifier 36 is connected to the reaction vessel 14 via a high pressure accumulator 42 which prevents the $CO_2$ from reacting with the contents of reaction vessel 14. The high pressure accumulator 42 is pressurized with carbon dioxide 44 from the pressure intensifier 36, and pressurizes the reaction vessel 14 with water 46. This system pressurizes the reaction vessels 12 and 14 equally to prevent transgress of electrolyte between reaction vessels 12 and 14 via the capillary connector. The pressurization may be stabilized initially, before an electrolysis reaction is initiated, by means of closing the valve 22 between the two reaction vessels 12 and 14. The high pressure accumulator 42 acts as a medium-separator to ensure that carbon dioxide does not enter the chamber of the second reactor 12, and at the same time ensures that the pressures in both the reactors 12 and 14 are equalised.

In use, the valve 22 is closed and $CO_2$ 24 in the liquid phase (from the high pressure $CO_2$ intensifier 36) and $H_2O$ 26 in the liquid phase are transferred into the reaction vessel 12; and $H_2O$ 26 is transferred into the reaction vessel 14 to provide the electrolytic fluids 28 and 30 in the reaction vessels 12 and 14, respectively. The high pressure intensifier 36 is used to apply and maintain a high and equal pressure within the reactors 12 and 14 and liquid phase conditions within the reaction vessels. Once the pressures within the vessels 12 and 14 are the same, the valve 22 may be opened, and there will be minimal fluid flow between the reactors 12 and 14. The liquid state of the electrolytic fluids 28 and 30 is maintained by maintaining suitable conditions of pressure and temperature within the reaction vessels 12 and 14. Preferably, the pressures within the reaction vessels 12 and 14 are maintained at 5.1 atm to 1000 atm, from 10 atm to 400 atm, preferably 10 to 200 atm.

The reaction vessel 14 is maintained at ambient temperature (20° C. to 30° C., typically 25° C.).

An electrolysis reaction is initiated by applying a direct voltage of −0.5 to −10 v and electrical current of 50 to 500 mA across the positive electrode 34 and negative electrode 32, on electrical circuit 35. The applied charge ionizes atoms in the electrolytic media 28 and 30. Electrons ($e^-$) flow from ion to adjacent ion between the electrodes 34 and 32 and thus through the capillary tube 16. Without wishing to be bound by theory, it is believed that: $H^+$, $(OH)^-$; $O^{2-}$ ions are formed in reaction vessel 14 and $H^+$, $C^{4+}$. $(CO)^{2-}$ ions are formed in reaction vessel 12. In the reaction vessel 12, carbon and hydrogen ions combine to form hydrocarbons, in particular methane, and other hydrocarbons. The initiation of the electrolysis process causes nascent (ionized) hydrogen ions to be formed from the $H_2O$ present in the electrolyte 30 and the carbon ions are split away from the $CO_2$ in the electrolyte 28. The $CO_2$ is thus reduced in the reaction vessel 12. In the reaction vessel 14, the electron flow causes oxygen ions which are negatively charged to be attracted to the positively charged electrode 34 therewithin, thus liberating the oxygen molecules at the electrode. H2 may also be formed in the reaction vessel 14.

The capillary tube 16 which may have unidirectional-flow oxygen properties is necessary to allow the transfer of electrons and keep the liberated oxygen in the reaction vessel 14 away from the reaction vessel 12 to avoid recombination with carbon and/or hydrogen there. The narrow dimension of the capillary tube 16 also serves to reduce heat conduction transfer so that different temperature conditions may be maintained in the reaction vessels 12 and 14 to enhance and facilitate the different reactions occurring therein and save energy costs. Being separated by the capillary separating the two reaction vessels when they are produced (ionized), the positively charged ions (carbon & hydrogen) are able to interact with themselves/each other and thus produce the desired products (hydrocarbons) in the reaction vessel 12.

The high pressure (>5.1 atm) further maintains the reactants in the liquid phase and thus increases the concentration of ions produced so that smaller equipment may be used to generate more product than possible in the gaseous phase.

The capillary tube 16 is necessary to allow the transfer of electrons which ionize the component atoms so that they are able to inter-react to form the new desired products. Being separated where they are produced (ionized) the positively charged ions (carbon & hydrogen) are only able to interact with themselves and thus produce the desired products (hydrocarbons) whereas the negative ions (oxygen) are separated from these and can only combine with themselves to form oxygen molecules. These can only be liberated at the electrodes where the final transfer of electrons ends.

By way of a pressure differential, electrolytic liquid from the reaction vessel 12 passes into an expansion vessel 48. The expansion vessel 48 is adapted to separate hydrocarbons 50 (typically methane formed in the reaction vessel 12), carbon 52, and a stream 54 containing $CO_2$, $H_20$ and CO. There may be several means of separation but the most preferable and likely will be the liquefaction or gasification at different temperatures and pressures of each product. The stream 54 containing $CO_2$, $H_2O$ and CO may be recycled to the reaction vessel 12 containing the −ve electrode 32, to increase the yield of the process.

By way of a pressure differential, electrolytic liquid from the reaction vessel 14 passes into a vessel 56. The vessel 56 is adapted to separate oxygen 58 and a stream 60 containing $H_2O$ and possibly $H_2$. The separation may be achieved using a centrifuge or differential phase change parameters. The stream 60 containing $H_2O$ and possibly $H_2$ may be recycled to the reaction vessel 12 containing the −ve electrode 32, to increase the yield of the process.

1 atm=1.01325 bar 1 atm=101.325 kPa

The invention is not limited to the embodiment/s illustrated in the drawings. Accordingly it should be understood that where features mentioned in the appended claims are followed by reference signs, such signs are included solely for the purpose of enhancing the intelligibility of the claims and are in no way limiting on the scope of the claims.

The invention will now be described in more detail with reference to the following non-limiting examples:

Example 1

1. Calculations 1.1 Electrochemistry

Reduction reactions ($CO_2 \rightarrow CH_4$)

$$CO_{2,(g)}+2H_{aq}^{+}+2e^{-} \leftrightarrow CO_{(g)}+H_2O_{(l)} -0.11\ V \quad (1)$$

$$CO_{(g)}+2H_{aq}^{+}+2e^{-} \leftrightarrow C_{(s)}+H_2O_{(l)} +0.52\ V \quad (2)$$

$$C_{(s)}+4H_{aq}^{+}+4e^{-} \leftrightarrow 2H_2O_{(l)}+CH_{4,(g)} +0.13\ V \quad (3)$$

Net Reduction Half Reaction $$CO_{2,(g)}+8H_{aq}^{+}+8e^{-} \leftrightarrow 2H_2O_{(l)}+CH_{4,(g)} +0.54\ V \quad (4)$$

Oxidation Half Reaction

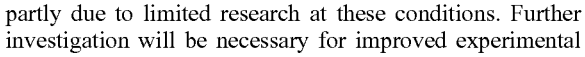

$$2H_2O_{(l)} \leftrightarrow O_{2,(g)} + 4H_{aq}^{+} + 4e^{-} - 1.23\ V \quad (5)$$

Net Redox Reaction

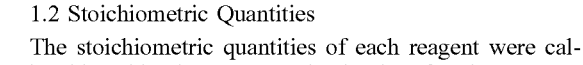

$$CO_{2,(g)} + 4H_{aq}^{+} + 4e^{-} \leftrightarrow O_{2,(g)} + CH_{4,(g)}\ 1.77\ V \quad (6)$$

According to these reactions, the potential difference necessary to be able to produce methane from carbon dioxide at normal conditions (room temperature, atmospheric pressure) is 1.77 V. The electrochemical behaviour was not well understood under the conditions investigated, partly due to limited research at these conditions. Further investigation will be necessary for improved experimental planning.

1.2 Stoichiometric Quantities

The stoichiometric quantities of each reagent were calculated by taking into account the density of each reagent at the specified conditions. Distilled water was used for all experiments.

The density of water was calculated by making use of equations (1) and (2) that calculates the density considering changes in temperature and pressure respectively.

$$\rho_{new} = \frac{\rho_{old}}{[1 + \beta(T_{new} - T_{old})]} \quad (1)$$

Where β is the volumetric temperature expansion coefficient ($m^3/m^3$.° C.), T is the temperature in ° C. and the ρ the density in $kg/m^3$.

$$\rho_{new} = \frac{\rho_{old}}{\left[1 - \frac{(P_{new} - P_{old})}{E}\right]} \quad (2)$$

Where P is in the pressure in $N/m^2$ (Pa), E is the bulk modulus fluid elasticity ($N/m^2$) and ρ is the density in $kg/m^3$.

The molar densities are calculated according to equation (3)

$$v = \frac{\rho}{1000 \times M} \quad (3)$$

Where ν is the molar density in $cm^3/mol$, ρ is the density in $kg/m^3$, and M is the molar mass in g/mol.

The quantities of each reagent are reported along with the operating conditions in the appropriate sections.

1.3 Supercritical Point

For the stoichiometric mixture or water and carbon dioxide, the critical point of the mixture can be estimated by equation (4) and (5). These estimates are summarised in Table 1.

$$T_{c,mixture} = \frac{n_{CO_2}}{n_{Tot}} \times T_{c,CO_2} + \frac{n_{H_2O}}{n_{Tot}} \times T_{c,H_2O} \quad (4)$$

$$P_{c,mixture} = \frac{n_{CO_2}}{n_{Tot}} \times P_{c,CO_2} + \frac{n_{H_2O}}{n_{Tot}} \times P_{c,H_2O} \quad (5)$$

TABLE 1

Supercritical point results from using equations (4) and (5).

| | Molecular Weight, M (g/mol) | Critical Temperature, $T_C$ (° C.) | Critical Pressure, $P_C$ (bar) |
|---|---|---|---|
| $CO_2$ | 44.01 | 31.1 | 73.7 |
| $H_2O$ | 18.02 | 374.3 | 221.0 |
| Mixture | 00.05 | 185.6 | 154.7 |

1.4 Carbon Dioxide

Figure 2:
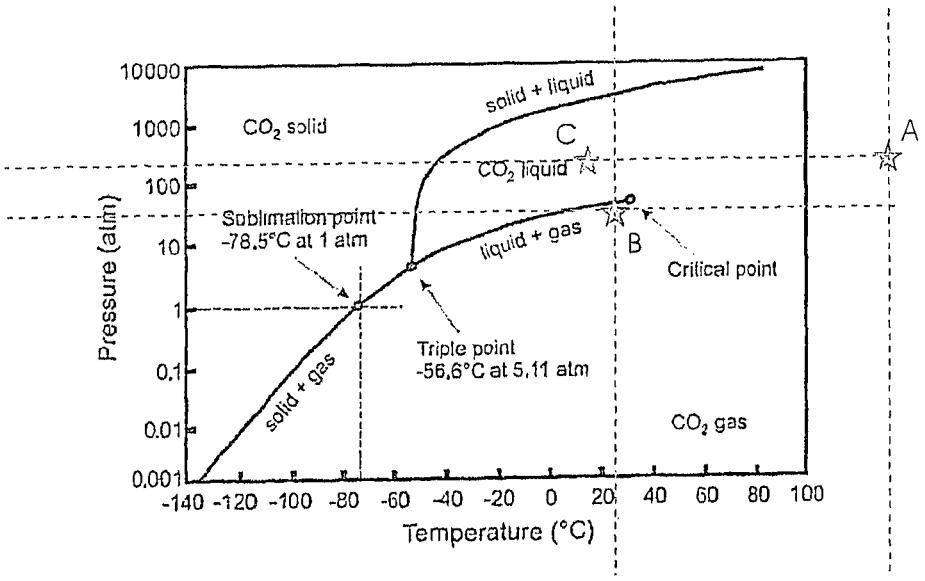
FIG. 2 is a phase diagram for carbon dioxide.
Figure 3:
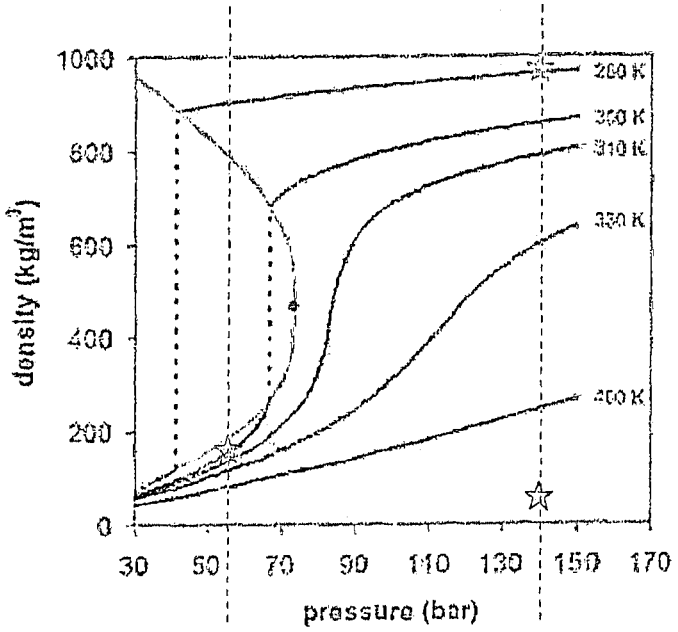
FIG. 3 is a density-pressure profile for carbon dioxide.

FIGS. 2 and 3 show the equilibrium conditions under which experiments were conducted.

In FIG. 2, "A" shows supercritical conditions, "B" shows conditions for Example 1A, and "C" shows conditions for Examples 1A Two Chamber Test with Capillary Tube A two chamber reactor system connected with a capillary tube as illustrated in the drawing was set up and operated with an electrical voltage of −6 v and electrical current of approximately 120 mA for 440 minutes. The test conditions for Example 1A are shown in Table 1 below. Both reactors 12 and 14 were operated at ambient temperature (25° C.).

TABLE 1

Two chamber Test Conditions

| Operating Conditions | | Reagent | Volume % | Volume (ml) |
|---|---|---|---|---|
| P (bar) | 65 | $CO_2$ | 84% | 33.5 |
| T (° C.) | 25 | $H_2O$ | 16% | 6.5 |

Figure 4:
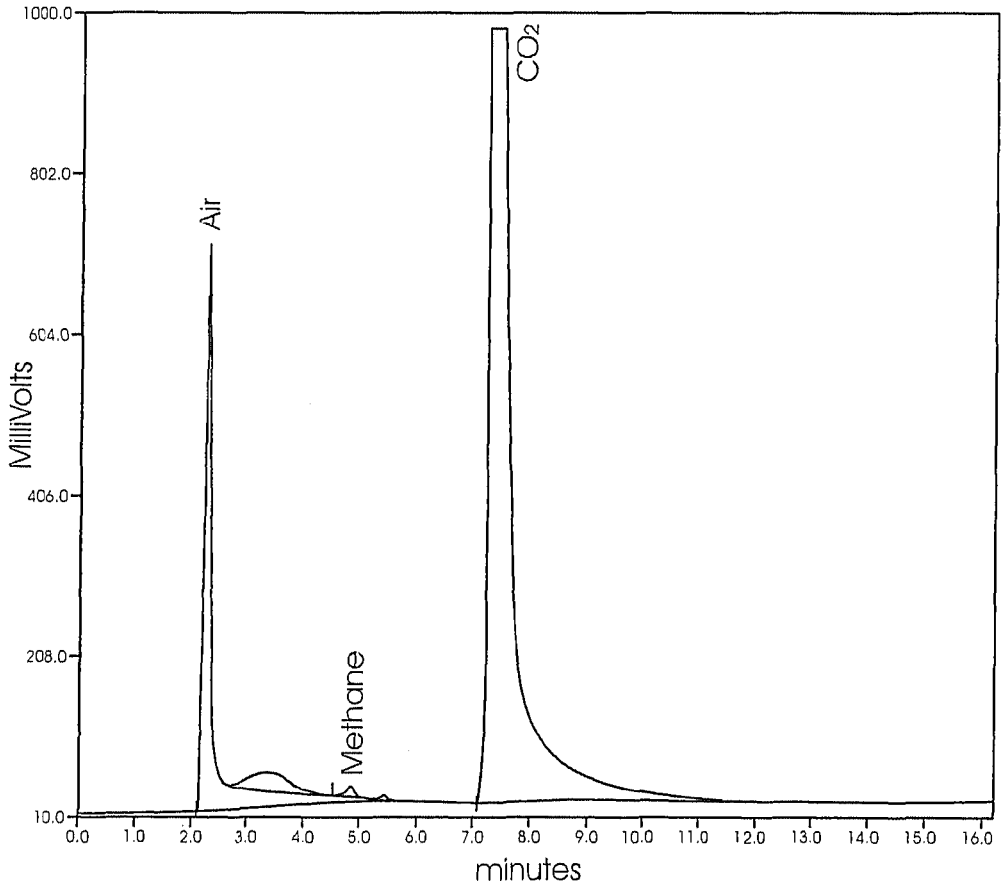
FIG. 4 is a gas chromatograph.

Detectable amounts of methane were produced in the reactor 12. Results generated by the gas chromatograph are shown in FIG. 4.

The chromatograph, the following components are shown:

Air: retention time 2.27, width 7.20, area 8354522.0, result 20.9

Methane: retention time 4.76, width 9.60, area 116449.8, result 0.3

$CO_2$: retention time 7.43, width 24.00, area 31502188.0, result 78.8

These results should not be interpreted in a quantitive manner, owing to the small volume of sample analysed. Some effects of the reaction were carbon precipitate observed on the cathode and the coloration of the cathode electrolyte. The anode remained unaffected, but slight coloration of the electrolyte was also visible.

Test conditions for Examples 1B-1I are provided in Table 2 below. In each case, reactor 14 was run at ambient temperature (22° C.). The temperatures shown in Table 2 is the temperature of the reactor 12.

The following conditions were used for the detection of methane in gaseous samples:

Gas chromatograph: HP 5890A

Column: 60/80 Carboxen-1000, 15'×⅛" SS (2.1 mm ID)

Oven temp: 45° C. (5.5 min) to 200° C. at 10° C./min

Injector temp: 80° C.

Detector: TCD

Detector temp: 250° C.

Injection volume: 0.3-1.0 ml

Retention times: 1. Oxygen: 5.00 min

2. Nitrogen: 5.49 min

3. Carbon monoxide: 7.37 min
4. Methane: 13.27 min
5. Carbon dioxide: 17.47 min

Methane was produced under the following conditions

TABLE 2

| Experiment | 1B | 1C | 1D | 1E |
|---|---|---|---|---|
| Temperature [° C.] | 22 | 22 | 80-120 | 22 |
| Pressure [bar] | 40 | 10 | 80-110 | 65-80 |
| Electrolyte | 0.5M NaKHCO3 | 0.1M KHCO3 | 0.1M KHCO3 | 0.5M KHCO3 |
| CH4 | Yes | Yes | Yes | Yes |
| **Experiment** | **1F** | **1G** | **1H** | **1I** |
| Temperature [° C.] | 22 | 22 | 80-120 | 22 |
| Pressure [bar] | 40 | 10 | 80-110 | 65-80 |
| Electrolyte | 0.5M NaHCO3 | 0.1M KHCO3 | 0.1M KHCO3 | 0.5M KHCO3 |
| CH4 | Yes | Yes | Yes | Yes |

Example 1J

Test Work at Low Temperature Conditions

The same system setup that was used for Example 1A was also used at comparatively low temperatures, by cooling reactor 12 down to approximately 7° C. Reactor 14 was at ambient temperature (22° C.). The test conditions are summarized in Table 3 below:

TABLE 3

Low Temperature Test Conditions

| Operating Conditions | | Reagent | Volume % | Volume (ml) |
|---|---|---|---|---|
| P (bar) | 140 | $CO_2$ | 56% | 22.3 |
| T (° C.) | 7 | $H_2O$ | 44% | 17.7 |

No detectable methane was produced at 140 bar and 7° C., but some methane could be detected at lower pressures (65 bar) at this temperature. Upon inspection, both electrodes were found to be clean and the electrolyte from both reactors was clear.

Conclusions

From what was observed, the following conclusions can be made:

Detectable amounts of methane could be produced using the two-chamber configuration connected by a capillary tube.

Detectable amounts of methane could be produced running the reactors 12 and 14 at the same internal pressure and different temperatures.

The invention claimed is:

1. An apparatus for the production of hydrocarbons from carbon dioxide and water, the apparatus comprising:

a first reaction vessel (14), adapted to operate at high pressure above 5.1 atm, for containing water in the liquid phase;

a second reaction vessel (12), adapted to operate at high pressure above 5.1 atm, for containing a mixture of carbon dioxide and water in the liquid phase;

a positive electrode located within the first reaction vessel (14);

a negative electrode located within the second reaction vessel (12);

and connection means, defined by one or more tube/s for containing liquid electrolytic medium, connecting electrolytic media in the first and second reaction vessels (14) and (12), wherein the tube/s include a membrane and the tube/s is/are provided with stopper means.

2. The apparatus as claimed in claim 1, wherein the tube/s is/are capillary tube/s.

3. The apparatus as claimed in claim 1, wherein the stopper means is a valve or valves.

4. The apparatus as claimed in claim 1, wherein the ratio of internal diameter to length of the/each tube is from 0.00001:1 to 0.1:1.

5. The apparatus as claimed in claim 4, wherein the ratio of internal diameter to length of the/each tube is from 0.00001:1 to 0.001:1.

6. The apparatus as claimed in claim 1, including a pressure intensifier for equalizing the pressures in both reaction vessels (12) and (14).

7. The apparatus as claimed in claim 6, wherein the pressure intensifier is pressurized with CO2, and pressurizes the second reaction vessel (12) directly with CO2, and a pressure accumulator is provided for pressurizing the first reaction vessel (14) with H2O.

* * * * *